US006112734A

United States Patent [19]

Kunimoto

[11] Patent Number: 6,112,734

[45] Date of Patent: Sep. 5, 2000

[54] MODEL GUN WITH AUTOMATIC BULLET SUPPYING MECHANISM

[75] Inventor: Keiichi Kunimoto, Tokyo, Japan

[73] Assignee: Western Arms, Tokyo, Japan

[21] Appl. No.: 09/226,218

[22] Filed: Jan. 7, 1999

[30] Foreign Application Priority Data

Jan. 8, 1998 [JP] Japan ..... 10-002187

[51] Int. Cl.[7] ..... F41B 11/00

[52] U.S. Cl. ..... 124/73; 124/56; 124/57; 124/60; 124/61; 124/73; 124/74

[58] Field of Search ..... 124/56, 57, 60, 124/71, 73, 74

[56] References Cited

U.S. PATENT DOCUMENTS

| | | |
|---|---|---|
| 2,566,181 | 8/1951 | Fitch . |
| 2,881,752 | 4/1959 | Blahnik . |
| 5,063,905 | 11/1991 | Farrell . |
| 5,280,778 | 1/1994 | Kotsiopoulos . |
| 5,476,087 | 12/1995 | Kunimoto . |
| 5,477,843 | 12/1995 | Kunimoto . |
| 5,505,188 | 4/1996 | Williams . |
| 5,509,399 | 4/1996 | Poor . |

FOREIGN PATENT DOCUMENTS

| | | |
|---|---|---|
| 2 603 374-A1 | 3/1988 | France . |
| 2730-125 | 1/1979 | Germany . |
| 3521800 | 9/1986 | Germany . |
| 1-285798 | 11/1989 | Japan . |
| 3-221793 | 9/1991 | Japan . |
| 3-236598 | 10/1991 | Japan . |
| 5-8285 | 2/1993 | Japan . |

*Primary Examiner*—Michael J. Carone
*Assistant Examiner*—Daniel Beitey
*Attorney, Agent, or Firm*—Nixon Peabody LLP; Donald R. Studebaker

[57] ABSTRACT

A model gun with automatic bullet supplying mechanism comprises a pressure accumulating chamber from which a gas leading passage extends, a slider movable along a barrel structure, a pressure receiving portion fixed in the slider at the back of the barrel structure, a movable member provided with first and second inner spaces and arranged at the back of a bullet holding chamber, and a movable valve provided in the first inner space formed in the movable member. The movable valve is operative selectively, during a period in which the gas leading passage is connected with the first and second inner spaces formed in the movable member, to cause gas derived through the gas leading passage from the pressure accumulating chamber to act through the first inner space on a sham bullet in the bullet holding chamber and to shut off gas flow to the bullet holding chamber through the first inner space from the gas leading passage so that the gas derived through the gas leading passage from the pressure accumulating chamber acts through the second inner space on the pressure receiving portion to cause first the pressure receiving portion to move back in company with the slider and then the movable member also to move back for making preparations for supplying the bullet holding chamber with a sham bullet from a magazine.

5 Claims, 11 Drawing Sheets

MODEL GUN WITH AUTOMATIC BULLET SUPPYING MECHANISM

BACKGROUND OF THE INVENTION

1. Field of the Invention

The present invention relates generally to a model gun with automatic bullet supplying mechanism, and more particularly to an improvement in a model gun having an automatic bullet supplying mechanism which is operative to make use of gas pressure for supplying automatically a bullet holding chamber provided in the rear portion of a barrel structure with a sham bullet which is to be shot with gas pressure.

2. Description of the Prior Art

A model gun which is often called an air soft gun is made to imitate a real gun in not only its color and shape but also its apparent operations. As for one of these model guns, which is made to imitate a real gun having a slider provided to be able to move back and forward along a barrel thereof in accordance with triggering action, it has been proposed to make such an arrangement that gas pressure is used for supplying a bullet holding chamber provided just at the back of a barrel with a sham bullet and further for shooting the sham bullet put in the bullet holding chamber, as shown in, for example, Japanese utility model application published before examination under publication number 3-38593. According to the arrangement thus proposed, a pressure accumulating bomb in which compressed air is contained and which has an air leading passage controlled to be open and closed selectively by an operation valve, a magazine for containing sham bullets, first and second valves, first and second air passages and a bullet supplying lever are provided in a grip, an air cylinder is positioned in a slider which is provided to be able to move back and forward along a barrel to be opposite to the rear end of the barrel with a magazine plate between, and a rotary cam engaging with the magazine plate to move the same upward and downward and a spring guide member which moves with the slider are further provided, so that each of the sham bullets contained in the magazine is supplied to the inside of the barrel and then shot through the barrel with the compressed air discharged from the pressure accumulating bomb.

In a model gun to which the above mentioned arrangement is applied, when a trigger is pulled, the first valve is caused to operate for permitting the compressed air discharged through the air leading passage opened by the operation valve from the pressure accumulating bomb to be introduced through the first air passage into the inside of the air cylinder and a piston provided in the air cylinder is moved with the pressure of the compressed air to cause the slider to move back. The air cylinder is shifted into the air exhausting condition after the slider has moved back to a predetermined position. The spring guide member also moves back together with the slider to compress a spring member and thereby the rotary cam is rotated to move the magazine plate downward. A bullet holding hole formed on the magazine plate is positioned to be opposite to the sham bullet if the sham bullet is pushed out of the magazine for containing sham bullets when the magazine plate is moved downward. Then, the sham bullet which has been pushed out of the magazine for containing sham bullets is put in the bullet holding hole on the magazine plate by the bullet supplying lever moved with the trigger.

After that, when the slider returns to the initial position under a condition wherein the air is exhausted from the air cylinder, the spring member is operative to return the spring guide member to the initial position thereof and therefore the rotary cam is rotated to move the magazine plate upward so that the bullet holding hole on the magazine plate in which the sham bullet is put is moved to the initial position to be opposite to the rear end of the barrel. When the magazine plate holding the sham bullet in the bullet holding hole formed thereon has reached the initial position, the second valve is caused to operate for permitting the compressed air discharged through the air leading passage opened by the operation valve from the pressure accumulating bomb to be introduced through the second air passage into the bullet holding hole formed on the magazine plate by a hammer which rotates with the movement of the trigger and the sham bullet put in the bullet holding hole is shot through the barrel with the compressed air introduced into the bullet holding hole.

With the previously proposed model gun in which the air cylinder is provided to form a pressure chamber in the slider which is provided to be movable along the barrel and the sham bullet is supplied to the bullet holding hole formed on the magazine plate by supplying the pressure chamber with the compressed air and discharging the compressed air from the pressure chamber as described above, it is possible to shoot a plurality of sham bullets successively under the automatic bullet supplying operation. However, under the condition in which the first and second valves are provided with relation to the pressure accumulating bomb in addition to the operation valve, an air control structure which comprises an interconnecting portion operative to hold the operation valve at the position for opening the air leading passage, a valve control mechanism for controlling the operation of the first valve, the hammer for controlling the operation of the second valve and so on, is so complicated on a large scale in its construction and therefore it is not easy to secure in a body of the model gun a space in which the air control structure is properly arranged. Further, since the first and second valves constituting the air control structure are arranged to be adjacent to each other for controlling substantially air pressure supplied to the air leading passage form the pressure accumulating bomb, relatively severe restrictions are put on the arrangement of the first and second valves so that freedom in design of the arrangement of the first and second valves is undesirably reduced.

OBJECTS AND SUMMARY OF THE INVENTION

Accordingly, it is an object of the present invention to provide a model gun with automatic bullet supplying mechanism, in which a bullet holding chamber to which a sham bullet is supplied to be shot with gas pressure supplied through a gas leading passage extending from a pressure accumulating chamber is provided in the rear portion of a barrel structure and a slider is provided to be moved back along the barrel structure with gas pressure supplied through the gas leading passage for making preparations for supplying the bullet holding chamber with the next sham bullet after the sham bullet in the bullet holding chamber is shot, and which avoids the aforementioned disadvantages encountered with the prior art.

Another object of the present invention is to provide a model gun with automatic bullet supplying mechanism, in which a bullet holding chamber to which a sham bullet is supplied to be shot with gas pressure supplied through a gas leading passage extending from a pressure accumulating chamber is provided in the rear portion of a barrel structure and a slider is provided to be moved back along the barrel structure with gas pressure supplied through the gas leading passage for making preparations for supplying the bullet holding chamber with the next sham bullet after the sham bullet in the bullet holding chamber is shot, and further in which a gas control structure which comprises a valve provided in a gas flow space formed in relation to the pressure accumulating chamber accompanied with the gas leading passage and is operative to control gas derived through the gas leading passage from the pressure accumulating chamber, is simplified on a relatively small scale in its construction.

A further object of the present invention is to provide a model gun with automatic bullet supplying mechanism, in which a bullet holding chamber to which a sham bullet is supplied to be shot with gas pressure supplied through a gas leading passage extending from a pressure accumulating chamber is provided in the rear portion of a barrel structure and a slider is provided to be moved back along the barrel structure with gas pressure supplied through the gas leading passage for making preparations for supplying the bullet holding chamber with the next sham bullet after the sham bullet in the bullet holding chamber is shot, and in which a gas control structure which comprises a valve provided in a gas flow space formed in relation to the pressure accumulating chamber accompanied with the gas leading passage and is operative to control gas derived through the gas leading passage from the pressure accumulating chamber is simplified on a relatively small scale in its construction and restrictions put on the arrangement of the valve provided in the gas flow space are effectively reduced.

According to the present invention, there is provided a model gun with automatic bullet supplying mechanism, which comprises a pressure accumulating chamber from which a gas leading passage extends, a first movable valve for controlling the gas leading passage to be open and closed selectively, a bullet holding chamber provided in the rear portion of a barrel structure, a slider provided to be movable along the barrel structure, a pressure receiving portion fixed in the slider to be positioned at the back of the barrel structure and movable with the slider, a movable member provided with a first inner space which opens toward the bullet holding chamber and is selectively connected with the gas leading passage and a second inner space which opens toward the pressure receiving portion and is selectively connected with the gas leading passage and arranged at the back of the bullet holding chamber to be movable along moving directions of the slider, and a second movable valve provided in the first inner space formed in the movable member, wherein, during a period in which the gas leading passage is connected with the first and second inner spaces formed in the movable member and the first movable valve controls the gas leading passage to be open, the second movable valve is operative selectively to cause gas derived through the gas leading passage from the pressure accumulating chamber to act through the first inner space formed in the movable member on a sham bullet in the bullet holding chamber and to shut off gas flow to the bullet holding chamber through the first inner space formed in the movable member from the gas leading passage so that the gas derived through the gas leading passage from the pressure accumulating chamber acts through the second inner space in the movable member on the pressure receiving portion to cause first the pressure receiving portion to move back in company with the slider and then the movable member also to move back for making preparations for supplying the bullet holding chamber with a sham bullet from a magazine.

Each of the first and second inner spaces formed in the movable member is selectively connected with the gas leading passage in dependence on the position of the movable member.

The second movable valve provided in the first inner space formed in the movable member may be forced to be put in tendency of moving in a direction for making the first inner space open and moved by pressure of gas reduced in the first inner space in a direction for making the first inner space closed.

In the model gun thus constituted in accordance with the present invention, a gas control device operative to control gas discharged from the pressure accumulating chamber is constituted mainly by the first movable valve for controlling the gas leading passage extending from the pressure accumulating chamber to be open and closed selectively and the second movable valve provided in the first inner space which is formed together with the second inner space in the movable member and selectively connected with the gas leading passage in dependence on the position of the movable member, wherein the second movable valve is operative selectively, during the period in which the first movable valve controls the gas leading passage to be open, to cause gas derived through the gas leading passage from the pressure accumulating chamber to act through the first inner space formed in the movable member on the sham bullet in the bullet holding chamber and to shut off gas flow to the bullet holding chamber through the first inner space formed in the movable member from the gas leading passage so that the gas derived through the gas leading passage from the pressure accumulating chamber acts through the second inner space formed in the movable member on the pressure receiving portion to cause first the pressure receiving portion to move back in company with the slider and then the movable member also to move back. This gas control device comprising the first and second movable valves is so provided as to be simplified on a relatively small scale in its construction and therefore it is easy to secure in the body of the model gun a space in which the gas control device is properly arranged. Besides, since the gas which is derived through the gas leading passage from the pressure accumulating chamber to act selectively on the sham bullet in the bullet holding chamber and on the pressure receiving portion which is movable with the slider, is controlled by the second movable valve as a single valve provided in the inner space formed in the movable member, restrictions put on the arrangement of the second movable valve in the model gun are effectively reduced.

With such simplified construction as mentioned above, each of the first and second inner spaces formed in the movable member is automatically connected with the gas leading passage extending from the pressure accumulating chamber selectively in dependence on the position of the movable member.

In the case where the second movable valve provided in the first inner space formed in the movable member is forced to be put in tendency of moving in the direction for making the first inner space open and moved by pressure of gas reduced in the first inner space in the direction for making the first inner space closed, the control of the gas which is derived through the gas leading passage from the pressure accumulating chamber to act selectively on the sham bullet in the bullet holding chamber and on the pressure receiving portion by the second movable valve provided in the passage connecting portion, is carried out much more surely and efficiently with relatively simple construction.

In the case where the passage connecting portion provided with the single connecting space which are connected in common to the first and second inner spaces in the movable member in dependence on the position of the movable member is employed, the control of the gas which is derived through the gas leading passage from the pressure accumulating chamber to act selectively on the sham bullet in the bullet holding chamber and on the pressure receiving portion by the second movable valve, is surely carried out with extremely simple and productive construction.

The above, and other objects, features and advantages of the present invention will become apparent from the following detailed description taken in conjunction with the accompanying drawings.

DESCRIPTION OF THE PREFERRED EMBODIMENTS

Figure 1:
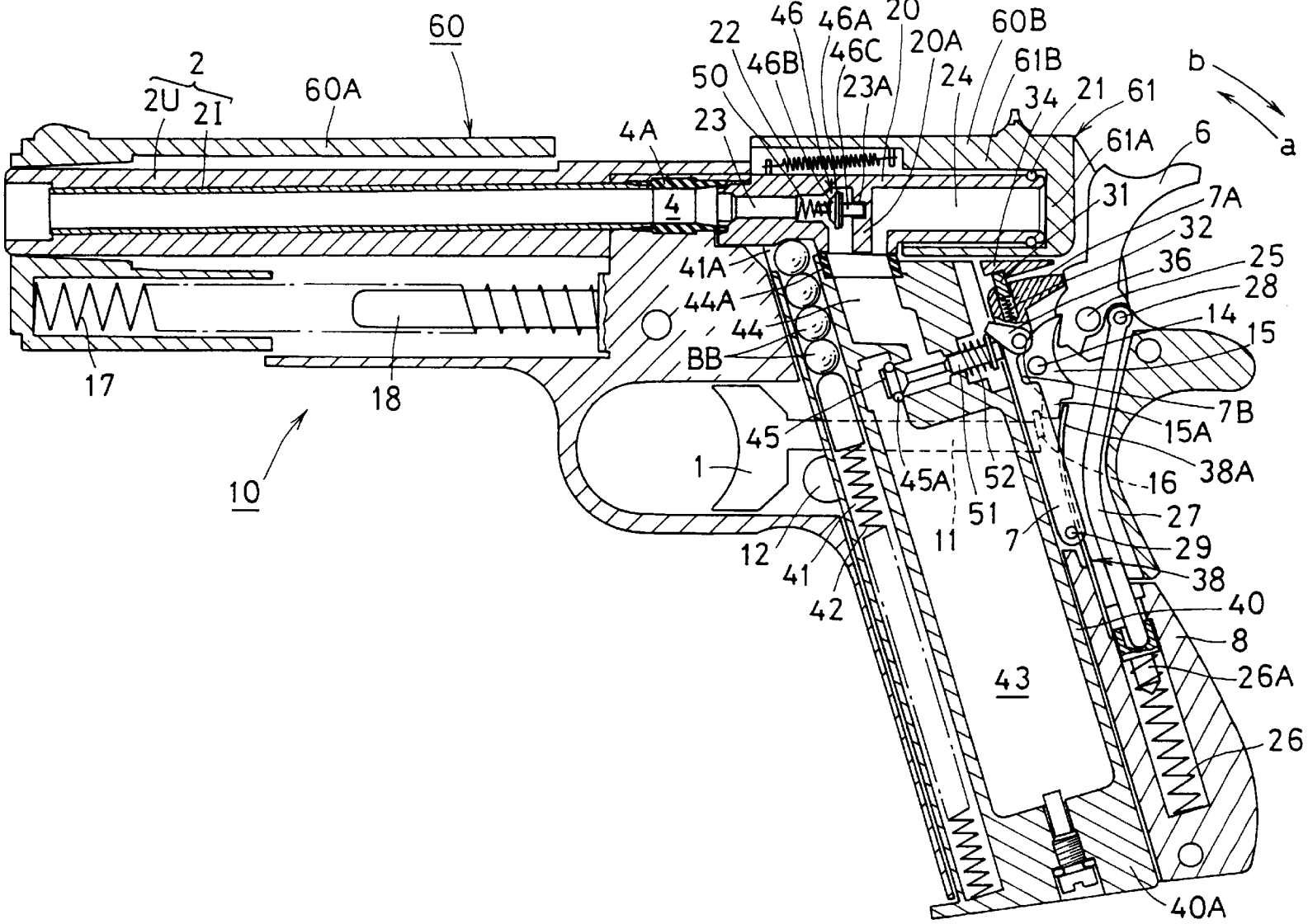
FIG. 1 is a schematic cross sectional view showing one embodiment of model gun with automatic bullet supplying mechanism according to the present invention.

FIG. 1 shows a first embodiment of model gun with automatic bullet supplying mechanism according to the present invention.

Referring to FIG. 1, the first embodiment has a body 10 in which a trigger 1, a barrel structure 2 including an outer barrel 2U and an inner barrel 2I, a bullet holding chamber 4 positioned in a rear portion of the barrel structure 2, a first hammer 6 and a second hammer 7 constituting a hammer structure, and a grip 8 are provided, a case 40 held to be detachable in the grip 8, and a slider 60 provided to be movable along the barrel structure 2. The bullet holding chamber 4 is formed in a tubular member 4A which is made of elastic frictional material, such as rubber, and coupled with a rear end portion of the inner barrel 2I.

A movable bar member 11 is provided in the grip 8 and the trigger 1 is provided to be movable in the direction along the barrel structure 2. When triggering, the trigger 1 is moved back from a reference position in front of a contact portion 12 provided on the body 10, and the movable bar member 11 is also moved back with the trigger 1. A movable contact member 16 is provided to be in contact with a rear end portion of the movable bar member 11. The movable contact member 16 comes selectively into contact with a rotary lever 15 which is attached with an axis 14 to the body 10.

The slider 60 has a front portion 60A and a rear portion 60B which is incorporated with the front portion 60A to be positioned at the back of the barrel structure 2 and is attached to be movable to a portion of the body 10 where the barrel structure 2 is provided. When the trigger 1 is put in the reference position, the slider 60 is put in a reference position with a front end of the front portion 60A positioned to be close to a front end of the body 10 and the rear portion 60B positioned to cover a mid portion of the body 10 between the barrel structure 2 and the grip 8.

The front portion 60A of the slider 60 is also engaged with a coil spring 17. The coil spring 17 is mounted on a guide member 18 which extends along the barrel structure 2 in front of the trigger 1 to be operative to exert the elastic force to the front portion 60A of the slider 60 to push the same forward, so that the slider 60 in its entirety is forced by the coil spring 17 to be put in tendency of moving forward.

In the rear portion 60B of the slider 60, a cup-shaped member 61 is provided to be fixed to the rear portion 60B and movable with the slider 60. A bottom of the cup-shaped member 61 constitutes a pressure receiving portion 61A.

Further, in the rear portion 60B of the slider 60, a movable member 20 is also provided. The movable member 20 is positioned at the back of the bullet holding chamber 4 to be movable along the moving directions of the slider 60 and has a rear portion which is put selectively in and out of a tubular portion 61B of the cup-shaped member 61, a front portion which is coupled selectively with the tubular member 4A in which the bullet holding chamber 4 is formed, and a mid portion between the rear and front portions. A sealing ring member 21 made of elastic material is mounted on the rear portion of the movable member 20. When the rear portion of the movable member 20 is inserted in the tubular portion 61B of the cup-shaped member 61, the sealing ring member 21 comes into contact with the inner surface of the tubular portion 61B to seal hermetically a space between the outer surface of the rear portion of the movable member 20 and the inner surface of the tubular portion 61B.

A coil spring 22 is provided with one end attached to the tubular portion 61B of the cup-shaped member 61 and the other end attached to the movable member 20 for exerting the elastic force to the movable member 20 to put the same in tendency of moving toward the pressure receiving portion 61A which is provided in the form of the bottom of the cup-shaped member 61. When the slider 60 is put in the reference position, the movable member 20 is put in such a position as to cause the front portion thereof to be coupled with the tubular member 4A in which the bullet holding chamber 4 is formed and to cause the rear portion thereof to be inserted in the tubular portion 61B of the cup-shaped member 61.

The movable member 20 is provided with a first inner space 23 and a second inner space 24 formed to be separated from each other by a partition wall 20A which is provided at the mid portion thereof. The first inner space 23 constitutes a curved gas passage with one end opening toward the bullet holding chamber 4 at the front portion of the movable member 20 and the other end opening downward at the mid portion of the movable member 20. The second inner space 24 constitutes also a curved gas passage with one end opening toward the pressure receiving portion 61A at the rear portion of the movable member 20 and the other end opening downward at the mid portion of the movable member 20. When the slider 60 is put in the reference position, one end of the first inner space 23 is connected with the bullet holding chamber 4 and one end of the second inner space 24 is positioned to face closely the pressure receiving portion 61A.

The first hammer 6 which constitutes the hammer structure in company with the second hammer 7 has an upper portion with which the cup-shaped member 61 comes selectively into contact and a lower portion provided with a plurality of engaging steps and is attached to be rotatable with an axis 25 to the rear end portion of the body 10 at the back of the second hammer 7. One end portion of a hammer strut 27 which has the other end portion connected with a axis 28 to the lower portion of the first hammer 6 engages through a cap 26A with a coil spring 26 provided in the lower portion of the grip 8, and thereby the first hammer 6 is forced through the hammer strut 27 and the cap 26A by the coil spring 26 to rotate in a direction indicated by an arrow a in FIG. 1 (a direction). In an initial condition wherein the case 40 is inserted into the grip 8, the first hammer 6 is so positioned that each of an engaging portion 7A provided on the second hammer 7 and an upper end of the rotary lever 15 engages with the lower portion of the first hammer 6.

The second hammer 7 has the engaging portion 7A at its upper end and is attached to be rotatable with an axis 29 to the body 10 at its lower end. A locking member 31 and a coil spring 32 are provided on an upper portion of the second hammer 7 and a notch 7B is also provided on a portion of the second hammer 7 facing the axis 14 extending through the rotary lever 15. Then, the second hammer 7 is forced by a toggle spring 30 provided on the axis 29, as shown in FIG. 2.

Figure 2:
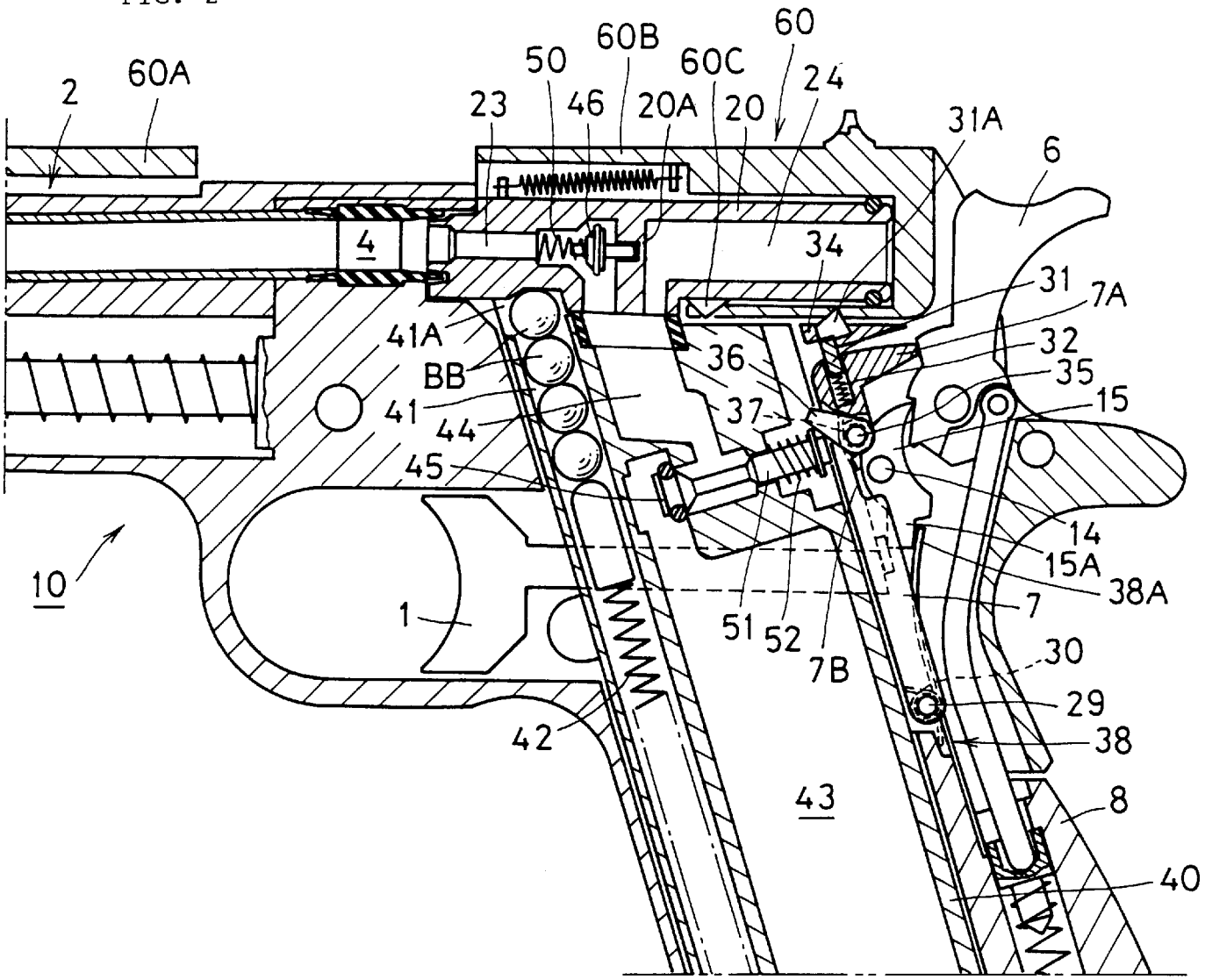
FIGS. 2, 3, 4, 5, 6, 7, 8, 9 and 10 are schematic cross sectional views used for explaining the construction and operation of the embodiment shown in FIG. 1.

The locking member 31 is forced by the coil spring 32 to be put in tendency of moving toward a bottom portion of the slider 60, as shown in FIG. 2. An upper portion of the locking member 31 forms a protrusion 31A projecting to be movable from the upper portion of the second hammer 7 toward the bottom portion of the slider 60.

The locking member 31 is selectively caused to come into contact with an engaging portion 34 provided on the body 10. When the locking member 31 is in contact with the engaging portion 34 to engage with the same, the position of the second hammer 7 is fixed by the locking member 31. Further, when the slider 60 is put in the reference position, the protrusion 31A formed by the upper portion of the locking member 31 is positioned at the back of a protrusion 60C projecting downward from the bottom portion of the slider 60. The protrusions 31A and 60C are provided respectively with inclined planes facing each other. When the slider 60 is moved back along the barrel structure 2 under a situation wherein the locking member 31 engages with the engaging portion 34, the protrusion 60C moves to cause the inclined plane provided thereon to come into contact with the inclined plane provided on the protrusion 31A and thereby to push down the protrusion 31A for passing through the position of the protrusion 31A. As a result, the protrusion 31A is moved toward the second hammer 7 and the locking member 31 is released from the engagement with the engaging portion 34.

The second hammer 7 is forced by the toggle spring 30 provided on the axis 29 to cause the engaging portion 7A to come into contact with the lower portion of the first hammer 6. In the initial condition wherein the case 40 is inserted into the grip 8, since the locking member 31 provided on the upper portion of the second hammer 7 engages with the engaging portion 34 provided on the body 10, the second hammer 7 is so positioned that the engaging portion 7A engages with the lower portion of the first hammer 6.

A rotary arm 36 is attached with an axis 35 to the second hammer 7. The rotary arm 36 is forced to rotate counterclockwise by a toggle spring 37 provided on the axis 35, as shown in FIG. 2.

The rotary lever 15 attached with the axis 14 to the body 10 is provided with a curved shape having the upper end engaging with the lower portion of the first hammer 6 and a lower portion 15A engaging with an engaging portion 38A of a leaf spring 38, as shown in FIG. 2. The rotary lever 15 is forced by the engaging portion 38A of the leaf spring 38 to cause the upper end thereof to come into contact with the lower portion of the first hammer 6. The leaf spring 38 is also provided with an engaging portion 38B for exerting the elastic force to the movable contact member 16 which is in contact with the rear end portion of the movable bar member 11, as shown in FIG. 3.

Figure 3:
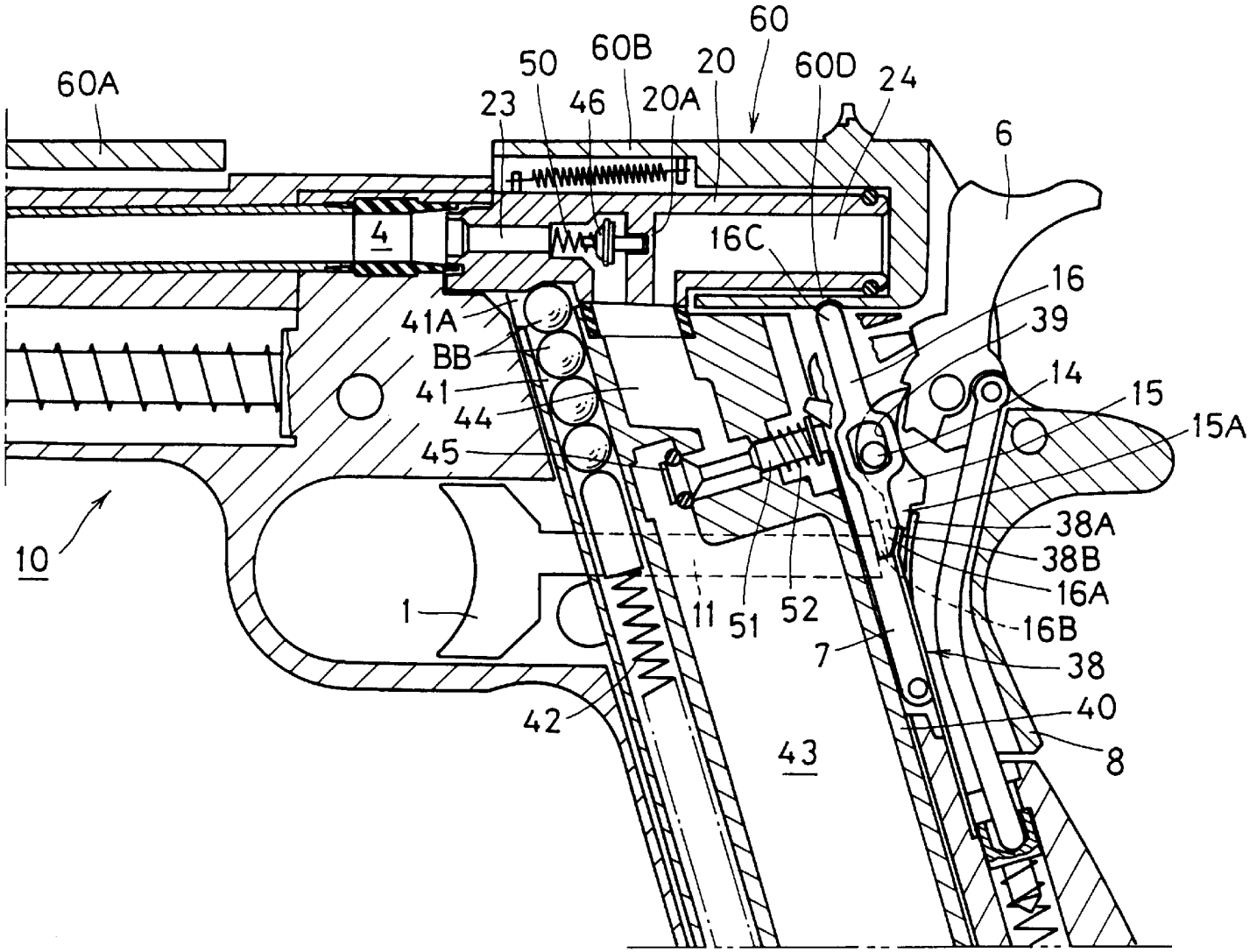

The movable contact member 16 has a lower inclined plane portion 16A with which the engaging portion 38B of the leaf spring 38 engages and a projection 16B extending from the lower inclined plane portion 16A in the direction along the width of the body 10 to come through a space around a lower portion 15A of the rotary lever 15 into contact with the rear end portion of the movable bar member 11, as shown in FIG. 3. An opening 39 though which the axis 14 extending through the rotary lever 15 passes is formed on a mid portion of the movable contact member 16 and thereby the movable contact member 16 is so supported by the axis 14 passing through the opening 39 as to be movable downward and backward against the elastic force exerted by the engaging portion 38B of the leaf spring 38 with the limitation set in accordance with the relative movement of the axis 14 to the opening 39. When the slider 60 is put in the reference position, the movable contact member 16 is forced by the engaging portion 38B of the leaf spring 38 to be held at an upper position for causing an upper end portion 16C to come into contact with a recess 60D provided on the bottom portion of the slider 60.

The leaf spring 38 is provided an engaging portion positioned between the engaging portion 38A for exerting the elastic force to the rotary lever 15 and the engaging portion 38B for exerting the elastic force to the movable contact member 16 to be in contact with the body 10. Lower ends of the engaging portions 38A and 38B and the engaging portion between the engaging portions 38A and 38B are connected with one another to be attached to the body 10.

The case 40 is inserted into the grip 8 through an opening provided at a lower end portion of the grip 8 and a bottom portion 40A of the case 40 is engaged with the lower end portion of the grip 8 so that the case 40 is held in the grip 8. The case 40 is provided therein with a magazine 41 for containing sham bullets BB, in which a coil spring 42 is provided for pushing the sham bullets BB toward an upper end portion 41A of the magazine 41, a pressure accumulating chamber 43 which is charged with, for example, liquefied gas, a gas leading passage 44 extending from the pressure accumulating chamber 43 with one end thereof connected with the pressure accumulating chamber 43, and a movable valve 45 provided in the gas leading passage 44. The gas leading passage 44 in which the movable valve 45 is provided is arranged over the pressure accumulating chamber 43 in the case 40.

The other end of the gas leading passage 44 has a relatively large diameter and is connected with both of the first and second inner spaces 23 and 24 formed in the movable member 20 when the movable member 20 provided in the slider 60 is put in a position corresponding to the reference position of the slider 60.

Accordingly, each of the first and second inner spaces 23 and 24 formed in the movable member 20 is connected with the gas leading passage 44 when the movable member 20 provided in the slider 60 is put in a position corresponding to the reference position of the slider 60. In such a situation, the other end of the gas leading passage 44 is connected with the other end of the first inner space 23 opening downward at the mid portion of the movable member 20 and the other end of the second inner space 24 opening downward at the mid portion of the movable member 20.

A portion of the gas leading passage 44 which comes into contact with the mid portion of the movable member 20 is constituted by a packing member 44A in which the other end of the gas leading passage 44 is formed. With the packing member 44A thus provided, gas leakage from the connection between the other end of the gas leading passage 44 and each of the other ends of the first and second inner spaces 23 and 24 each opening downward at the mid portion of the movable member 20 is surely prevented.

A movable valve 46 is provided in the first inner space 23 formed in the movable member 20 for constituting a gas control device to the pressure accumulating chamber 43 together with the movable valve 45 provided in the gas leading passage 44. The movable valve 46 is provided with a large diameter portion 46B to which a ring seal member 46A is attached and a shaft portion 46C extending from the large diameter portion 46B and accommodated in a bent portion of the first inner space 23 formed in the movable member 20. The shaft portion 46C of the movable valve 46 is inserted into a guide hole 23A formed on the partition wall 20A which is provided at the mid portion of the movable member 20 and forced by a coil spring 50 engaging with the large diameter portion 46B to cause its end to come into contact with a bottom of the guide hole 23A. Accordingly, the movable valve 46 accommodated in the first inner space 23 formed in the movable member 20 is normally positioned to cause the large diameter portion 46B to be distant from one end of the first inner space 23 so as to make the first inner space 23 formed in the movable member 20 open, as shown in FIGS. 1 to 3.

Under a predetermined condition described later, the movable valve 46 accommodated in the first inner space 23 formed in the movable member 20 is moved against the elastic force exerted by the coil spring 50 to compress the coil spring 50 and positioned to make the first inner space 23 closed. The second inner space 24 formed in the movable member 20 is maintained to be always open regardless of the position of the movable valve 46 in the first inner space 23 formed in the movable member 20.

The movable valve 45 is provided in the gas leading passage 44 for controlling the gas leading passage 44 to be open and closed selectively in dependence on the position thereof. A ring seal member 45A is mounted on the movable valve 45 and a rod 51 is incorporated with the movable valve 45. The movable valve 45 is forced by a coil spring 52 mounted on a rear portion of the rod 51 projecting from the gas leading passage 44 to the outside to be normally positioned to make the gas leading passage 44 closed, as shown in FIGS. 1 to 3.

As described above, with the arrangement in which the gas leading passage 44 is provided over the pressure accumulating chamber 43 in the case 40 held in the grip 8 and the movable valve 45 is provided in the gas leading passage 44, the gas leading passage 44 from the pressure accumulating chamber 43 to the first and second inner spaces 23 and 24 in the movable member 20, which is constituted to be subjected to necessary controls under the situation wherein the slider 60 is put in the reference position, can be made to be relatively short in the total length.

In the condition wherein the slider 60 is put in the reference position and the case 40 is held in the grip 8 in such a manner as shown in FIGS. 1 to 3, the upper end portion 41A of the magazine 41 is positioned to be close to the bullet holding chamber 4 and closed by the mid portion of the movable member 20. Therefore, the sham bullets BB contained in the magazine 41 are pushed against the elastic force by the coil spring 42.

In this condition, one end of the first inner space 23 formed in the movable member 20 is connected to the bullet holding chamber 4, one end of the second inner space 24 formed in the movable member 20 is positioned to face closely the pressure receiving portion 61A, and the other end of the gas leading passage 44 extending from the pressure accumulating chamber 43 is connected with the other end of each of the first and second inner spaces 23 and 24 formed in the movable member 20. Further, the rotary arm 36 provided on the second hammer 7 is forced by the toggle spring 37 (shown in FIG. 2) to come into contact with a rear end portion of the rod 51 extending from the movable valve 45 which is positioned to make the gas leading passage 44 open and to be fixed in position.

Figure 4:
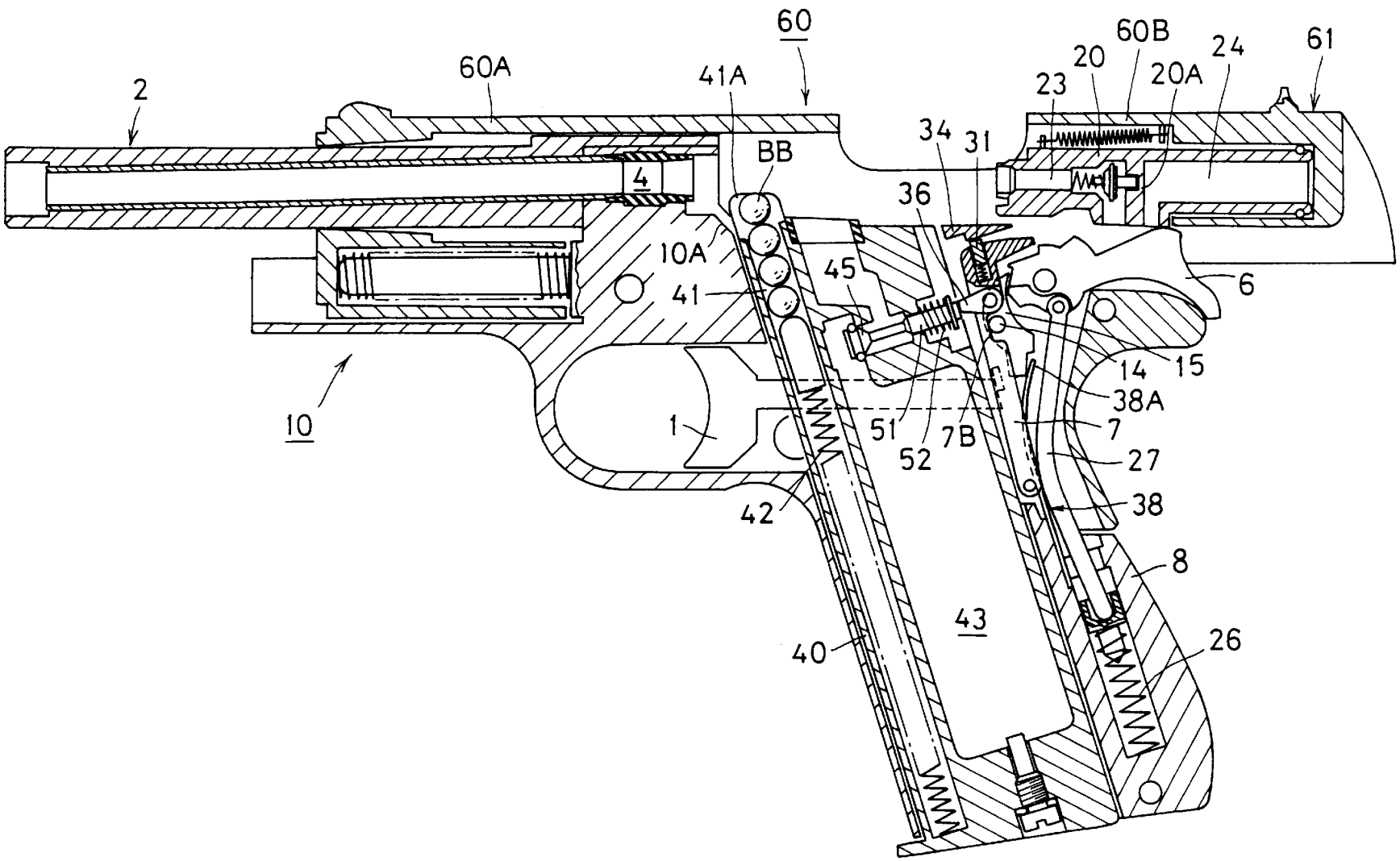

In the embodiment shown in FIGS. 1 to 3 and constituted as described above, after the case 40 has been held in the grip 8, the slider 60 is once moved back with the movable member 20 manually from the reference position and then released to return with the movable member 20 to the reference position with the elastic force by the coil spring 17. During such movements of the slider 60, the movable member 20 which has its mid portion making the upper end portion 41A of the magazine 41 closed is moved back with the backward movement of the slider 60, so that the upper end portion 41A of the magazine 41 is made open and one of the sham bullets BB at the top in the magazine 41 is pushed up into the upper end portion 41A of the magazine 41 to be held therein by the coil spring 42, as shown in FIG. 4.

When the slider 60 is manually moved back, the first hammer 6 is pushed to rotate by the cup-shaped member 61, which moves back in company with the slider 60, from the position shown in FIG. 1 against the elastic force by the coil spring 26 in a direction indicated by an arrow b in FIG. 1 (b direction) and opposite to the a direction, and thereby, the rotary lever 15 is rotated in the direction following the elastic force by the engaging portion 38A of the leaf spring 38.

Further, with the backward movement of the slider 60, the locking member 31 provided on the second hammer 7 is released from the engagement with the engaging portion 34. Therefore, when the first hammer 6 is rotated in the b direction, the second hammer 7 is also rotated in the direction following the elastic force by the toggle spring 30 (shown in FIG. 2). The upper end of the rotary lever 15 engages with the lower portion of the first hammer 6 which has been moved back, so that the first hammer 6 and the rotary lever 15 are mutually fixed in position, as shown in FIG. 4. The second hammer 7 having rotated in accordance with the rotation of the first hammer 6 in the b direction is fixed in position with the notch 7B provided thereon and making contact with the axis 14. With the rotation of the second hammer 7, the rotary arm 36 attached to the second hammer 7 is forced to rotate by the toggle spring 37 (shown in FIG. 2) and fixed in position to be in contact with the rear end portion of the rod 51 extending from the movable valve 45.

Figure 5:
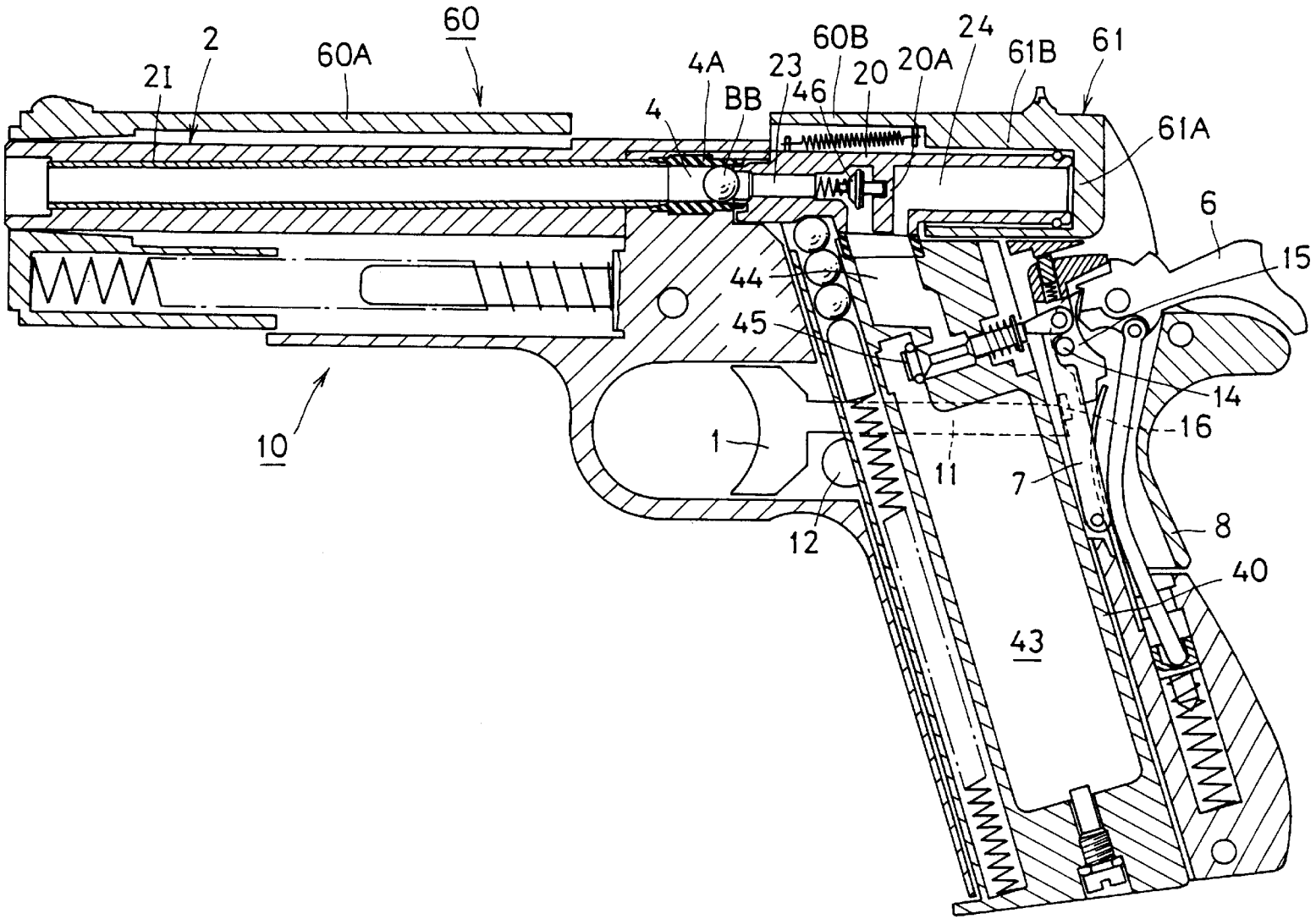

Then, when the slider 60 moves forward after having been manually moved back, the movable member 20 is also moved forward with the forward movement of the slider 60 so as to cause the front portion thereof to come into the upper end portion 41A of the magazine 41 and to carry the sham bullet BB in the upper end portion 41A of the magazine 41 along a slope 10A formed in the body 10 to the bullet holding chamber 4. On that occasion, the movable member 20 is operative further to cause the mid portion thereof to make the upper end portion 41A of the magazine 41 closed again and to cause the front portion thereof to be connected again to the bullet holding chamber 4 formed by the tubular member 4A so that the movable member 20 is fixed in position. As a result, the sham bullet BB is supplied to the bullet holding chamber 4, as shown in FIG. 5.

When the slider 60 has returned to the reference position after its forward movement for supplying the bullet holding chamber 4 with the sham bullet BB, the other end of the gas leading passage 44 extending from the pressure accumulating chamber 43 is again connected with the other end of each of the first and second inner spaces 23 and 24 formed in the movable member 20 under the condition wherein one end of the first inner space 23 is connected with the bullet holding chamber 4 and one end of the second inner space 24 is positioned to face closely the pressure receiving portion 61A.

Figure 6:
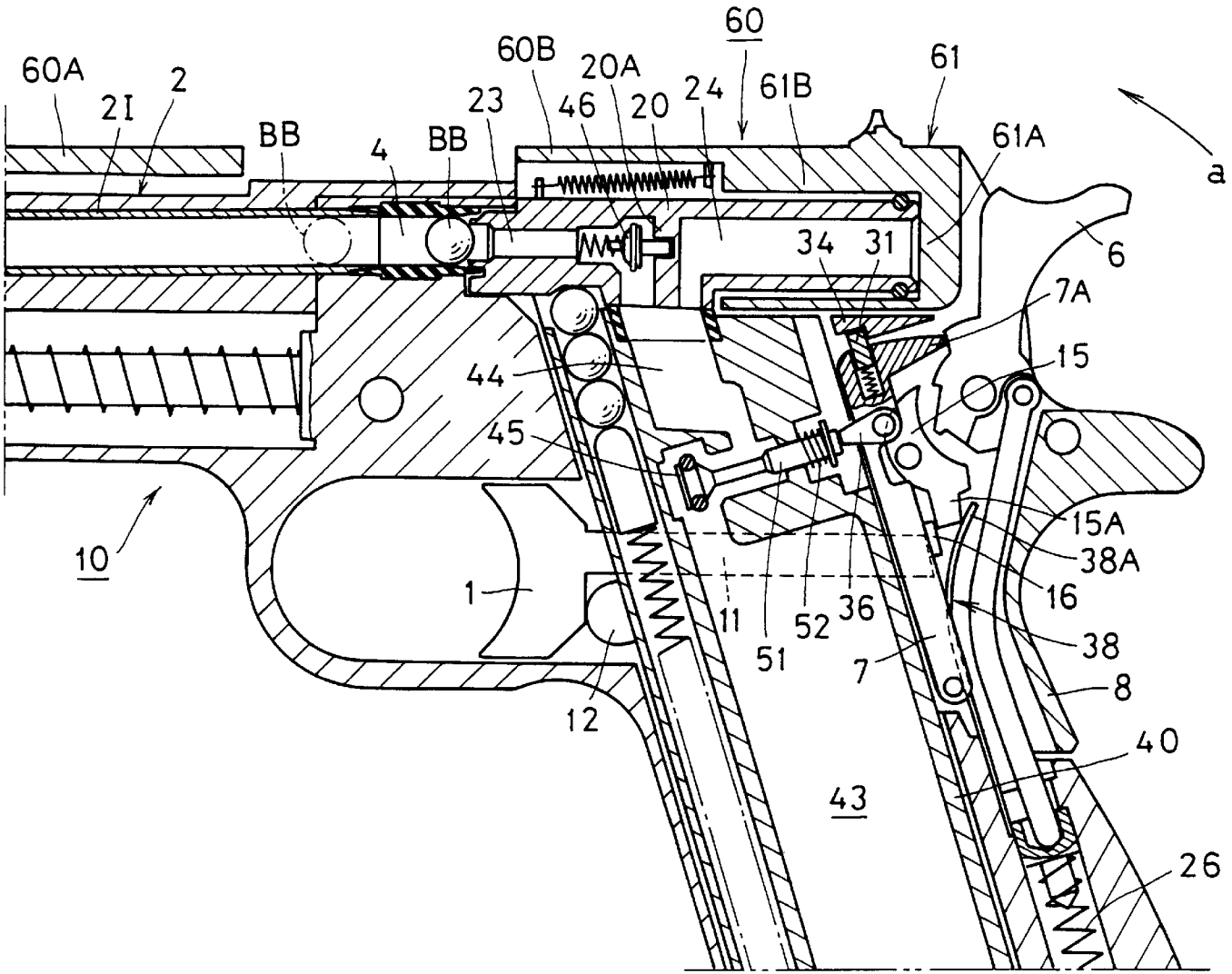

After the sham bullet BB has been supplied to the bullet holding chamber 4 as described above and shown in FIG. 5, when the trigger 1 is pulled, the movable bar member 11 is moved back. With the backward movement of the movable bar member 11, the movable contact member 16 which is in contact with the rear end portion of the movable bar member 11 at its upper position moves to push back the lower portion 15A of the rotary lever 15 and cause the rotary lever 15 to rotate against the elastic force exerted by the engaging portion 38A of the leaf spring 38, as shown in FIG. 6. As a result, the upper end of the rotary lever 15 is released from the engagement with the lower portion of the first hammer 6.

The first hammer 6 released from the positional restriction by the rotary lever 15 is rotated by the coil spring 26 in the a direction with its lower portion with which the engaging portion 7A of the second hammer 7 is in contact. The first hammer 6 rotating in the a direction causes the second hammer 7 to rotate also in the a direction. Then, the rotary arm 36 attached to the second hammer 7 is operative to push the rod 51 extending from the movable valve 45 and compress the coil spring 52 simultaneously with a time point at which the trigger 1 comes into contact with the contact portion 12.

When the rod 51 is pushed by the rotary arm 36 in such a manner as mentioned above, the movable valve 45 is moved from the position for making the gas leading passage 44 closed to another position for making the gas leading passage 44 open and therefore the gas leading passage 44 is made open. With the rotation of the second hammer 7 in this situation, the rocking member 31 is positioned to come into contact with the engaging portion 34 provided on the body 10. Therefore, the second hammer 7 is limited to rotate in the direction following the elastic force by the toggle spring 30 and operative to cause the movable valve 45 to keep the position for making the gas leading passage 44 open. Further, the first hammer 6 is fixed in position, without positional restriction by the rotary lever 15, by the second hammer 7 limited to rotate in the direction following the elastic force by the toggle spring 30.

The gas derived through the gas leading passage 44, which is made open by the movable valve 45, from the pressure accumulating chamber 43 flows immediately into the movable member 20. In this situation, the movable valve 46 accommodated in the first inner space 23 formed in the movable member 20 is put in the position for making the first inner space 23 open and therefore the first and second inner spaces 23 and 24 formed in the movable member 20 are filled with the gas flowing into the movable member 20. Then, the gas passing through the first inner space 23 formed in the movable member 20 reaches to the sham bullet BB in the bullet holding chamber 4 and the gas passing through the second inner space 24 formed in the movable member 20 reaches to the pressure receiving portion 61A.

Figure 7:
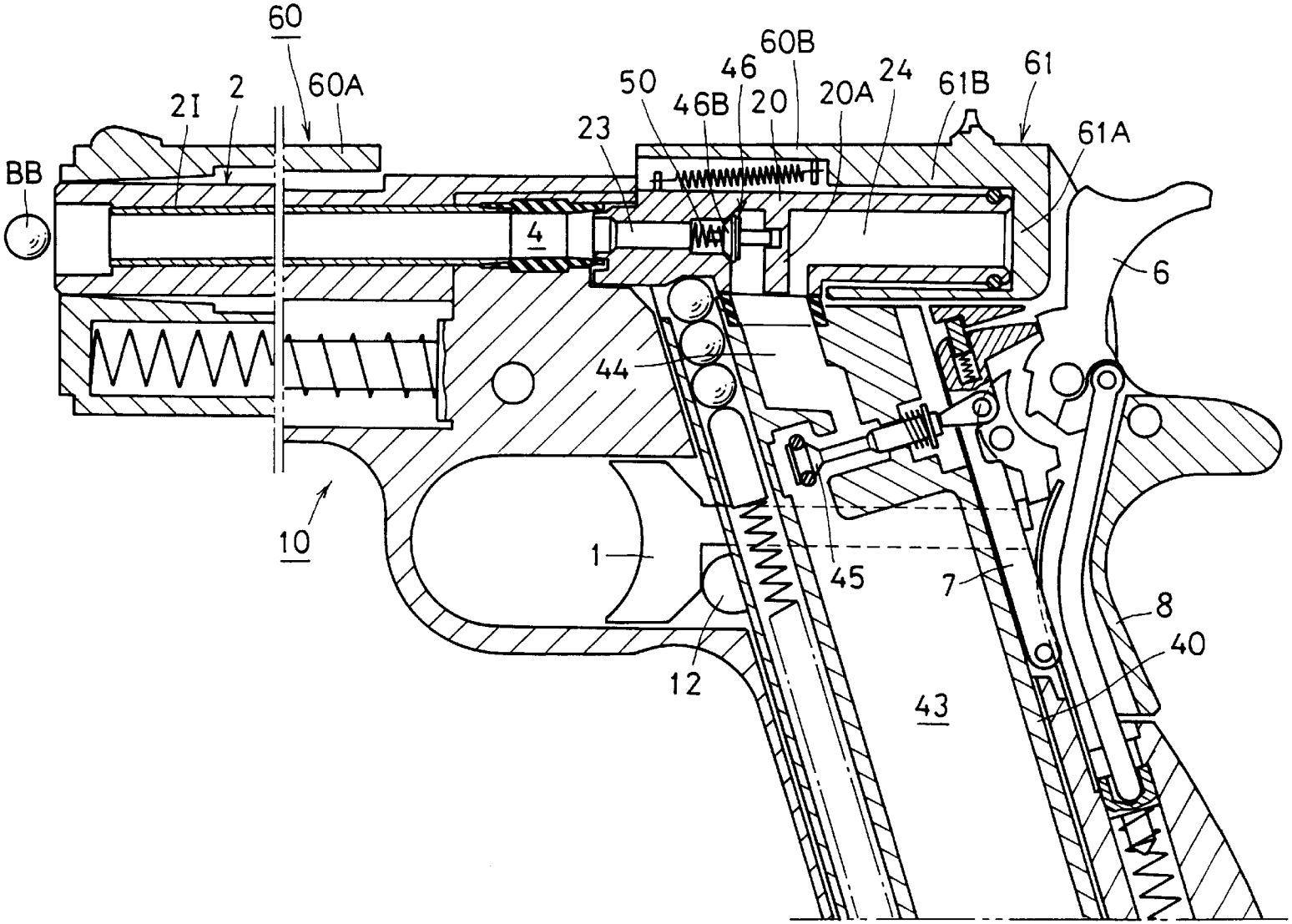

The pressure of gas necessary for pushing the sham bullet BB forward from the bullet holding chamber 4 into the inner barrel 2I is arranged to be smaller than the pressure of gas necessary for moving the pressure receiving portion 61A accompanied with the cup-shaped member 61 and the slider 60 back to go away from the barrel structure 2. Accordingly, the sham bullet BB held in the bullet holding chamber 4 as shown with a solid line in FIG. 6 is caused by the pressure of the gas supplied thereto to move from the bullet holding chamber 4 into the inner barrel 2I, as shown with a dot-dash line in FIG. 6, under a condition wherein the pressure receiving portion 61A is not moved back by the pressure of the gas in company with the cup-shaped member 61 and the slider 60. The sham bullet BB moved into the inner barrel 2I is accelerated to move forward along the inner barrel 2I by gas flowing continuously into the inner barrel 2I from the first inner space 23 formed in the movable member 20 and then shot from a front end of the inner barrel 2I, as shown in FIG. 7.

When the sham bullet BB has been shot from the inner barrel 2I, the gas flowing into the inner barrel 2I from the first inner space 23 formed in the movable member 20 is discharged into the atmosphere from the front end of the inner barrel 2I and therefore the pressure of gas in each of the inner barrel 2I and the first inner space 23 formed in the movable member 20 is rapidly reduced. Such rapid reduction in the pressure of gas in the first inner space 23 formed in the movable member 20 acts on the movable valve 46 accommodated in the first inner space 23 as negative pressure for drawing the movable valve 46 toward one end of the first inner space 23. As a result, the movable valve 46 is moved toward one end of the first inner space 23 against the elastic force by the coil spring 50 and the large diameter portion 46B of the movable valve 46 comes into contact with a bore forming the bent portion of the first inner space 23 so as to make the first inner space 23 closed. Consequently, the movable valve 46 accommodated in the first inner space 23 formed in the movable member 20 is operative to shut off gas flow to the bullet holding chamber 4 through the first inner space 23 from the gas leading passage 44.

Figure 8:
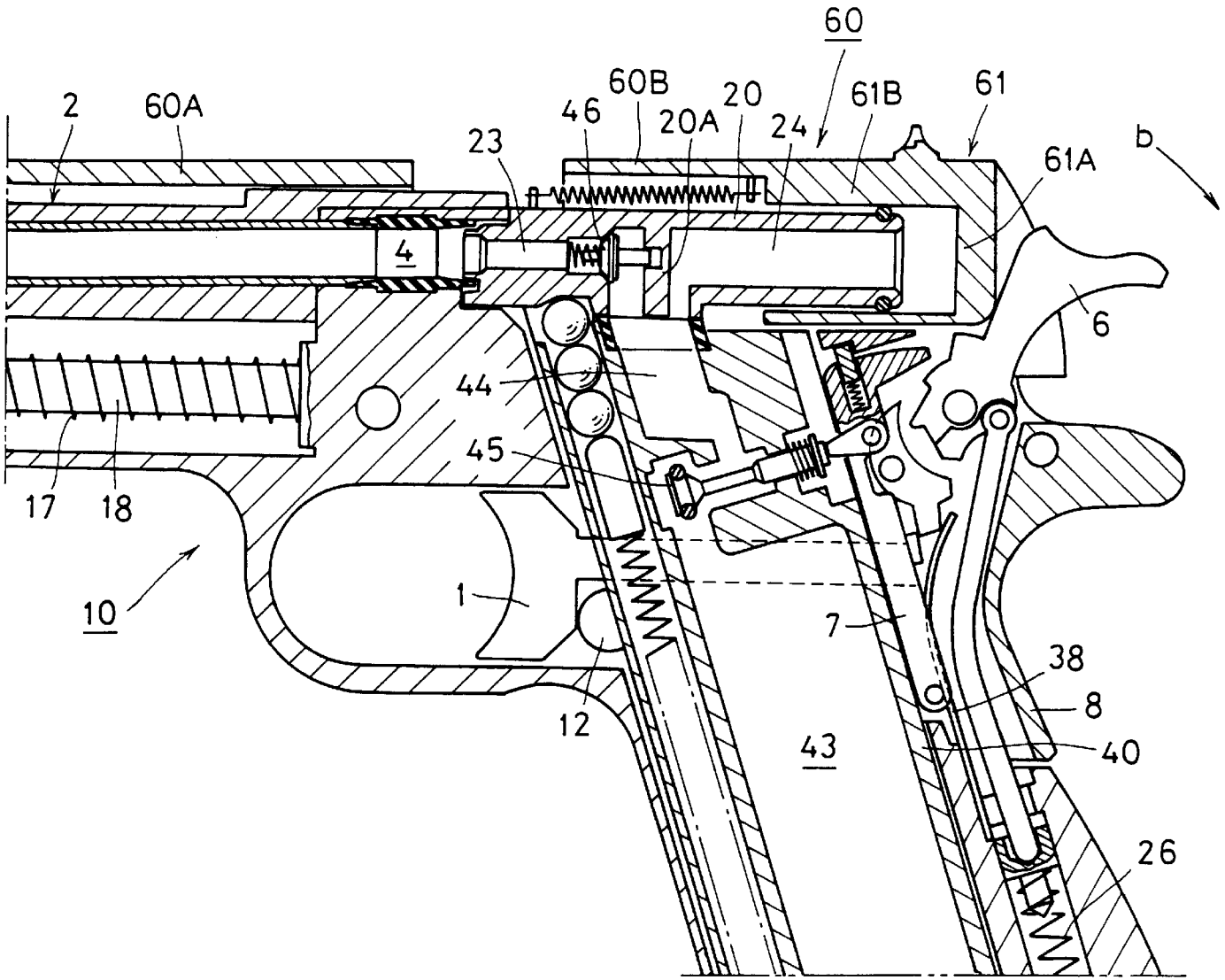

When the gas flow to the bullet holding chamber 4 through the first inner space 23 formed in the movable member 20 from the gas leading passage 44 is shut off by the movable valve 46 accommodated in the first inner space 23, the gas flowing into the movable member 20 through the gas leading passage 44 from the pressure accumulating chamber 43 flows further through the second inner space 24 formed in the movable member 20 toward the pressure receiving portion 61A, without flowing into the first inner space 23, and the pressure of gas acting on the pressure receiving portion 61A is rapidly increased. With the pressure of gas thus increased rapidly, the pressure receiving portion 61A is rapidly moved back so as to cause a pressure chamber formed at the back of the rear portion of the movable member 20 in the cup-shaped member 61 to increase in capacity and the slider 60 is also moved back rapidly in company with the pressure receiving portion 61A against the elastic force by the coil spring 17, as shown in FIG. 8. When the slider 60 is moved back, the first hammer 6 is rotated by the slider 60 moving back in the b direction against the elastic force by the coil spring 26.

Figure 9:
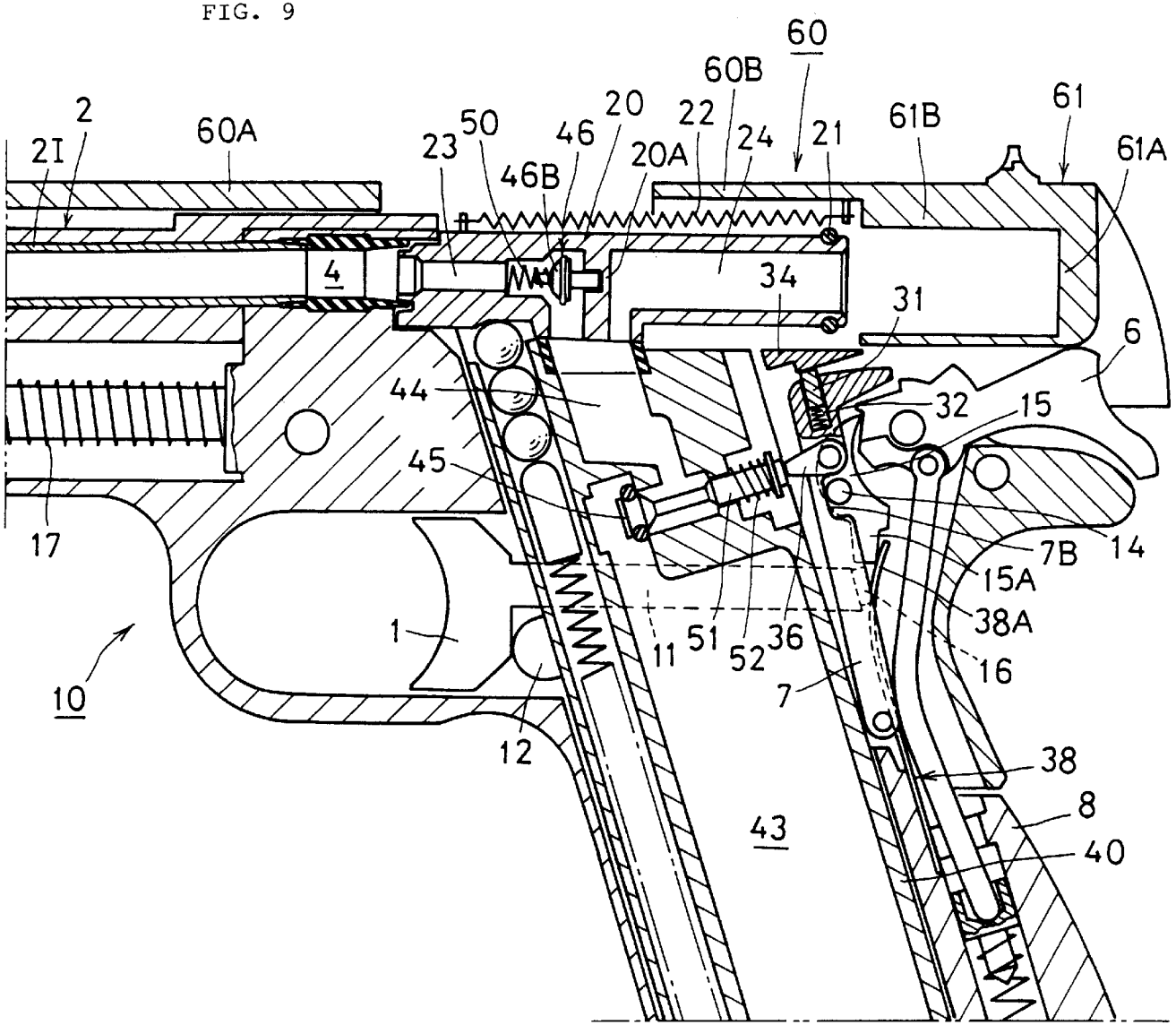

Then, the pressure receiving portion 61A is further moved back in company with the slider 60 by the pressure of gas flowing through the second inner space 24 formed in the movable member 20 into the pressure chamber formed at the back of the rear portion of the movable member 20 in the cup-shaped member 61, as shown in FIG. 9. With such backward movement of the slider 60, the movable contact member 16 which is in contact with the bottom portion of the slider 60 is released from the positional restriction by the recess 60D provided on the bottom portion of the slider 60, as shown in FIG. 3, and pushed down against the elastic force by the engaging portion 38B of the leaf spring 38 to be put in the lower position. As a result, the lower portion 15A of the rotary lever 15 is released from the engagement with the movable contact member 16 and thereby the rotary lever 15 rotates in the direction following the elastic force by the engaging portion 38A of the leaf spring 38.

Further, with the backward movement of the slider 60, the locking member 31 provided on the second hammer 7 is pushed down against the elastic force by the coil spring 32 by the protrusion 60C provided on the bottom portion of the slider 60, as shown in FIG. 2, to be released from the engagement with the engaging portion 34 provided on the body 10. Therefore, the second hammer 7 is released from the positional restriction and rotated in the direction following the elastic force by the toggle spring 30 (shown in FIG. 2).

The rotary lever 15 which is forced to rotate by the engaging portion 38A of the leaf spring 38 engages with the lower portion of the first hammer 6 so that the rotary lever 15 and the first hammer 6 are mutually fixed in position. The second hammer 7 which is forced to rotate by the toggle spring 30 is fixed in position with the notch 7B provided thereon with which the axis 14 is in contact.

With the rotation of the second hammer 7 caused by the toggle spring 30, the movable valve 45 is released from the positional restriction by the rotary arm 36 which is in contact with the rear end portion of the rod 51 extending from the movable valve 45. The movable valve 45 having been released from the positional restriction by the rotary arm 36 is put in the position for making the gas leading passage 44 closed by the pressure of gas acting thereon and the elastic force exerted by the coil spring 52, as shown in FIG. 9.

Accordingly, under the situation described above, during a period in which the gas leading passage 44 extending from the pressure accumulating chamber 43 is connected with the first and second inner spaces 23 and 24 formed in the movable member 20 and the movable valve 45 controls the gas leading passage 44 to be open under the condition wherein the slider 60 is put in the reference position and the movable member 20 is put in the position corresponding to the reference position of the slider 60, the movable valve 46 accommodated in the first inner space 23 formed in the movable member 20 is operative selectively to control the first inner space 23 to be open so as to cause the gas derived through the gas leading passage 44 from the pressure accumulating chamber 43 to act through the first inner space 23 on the sham bullet BB in the bullet holding chamber 4 and to control the first inner space 23 to be closed so as to shut off the gas flow to the bullet holding chamber 4 through the first inner space 23 from the gas leading passage 44 so that the gas derived through the gas leading passage 44 from the pressure accumulating chamber 43 acts through the second inner space 24 formed in the movable member 20 on the pressure receiving portion 61A to cause the pressure receiving portion 61A to move back in company with the slider 60.

With such operations of the movable valve 46, the slider 60 is moved back by the pressure of gas acting on the pressure receiving portion 61A, which is rapidly increased after the sham bullet BB is shot from the inner barrel 2I, and therefore the movements of the slider 60 do not exert any bad influence on the barrel structure 2 at the shooting of the sham bullet BB. Consequently, the direction of the sham bullet BB shot from the inner barrel 21 is properly set without being undesirably varied.

When the gas leading passage 44 is closed by the movable valve 45, as shown in FIG. 9, the gas flow to the gas leading passage 44 from the pressure accumulating chamber 43 and the gas flow to the pressure receiving portion 61A through the second inner space 24 formed in the movable member 20 from the gas leading passage 44 vanish away. Then, the pressure of gas in the first inner space 23 formed in the movable member 20 is reduced and thereby the movable valve 46 accommodated in the first inner space 23 is moved by the coil spring 50 to return to the position at which the large diameter portion 46B of the movable valve 46 is away from the bore forming the bent portion of the first inner space 23, as shown in FIG. 9, and the first inner space 23 is made open.

Figure 10:
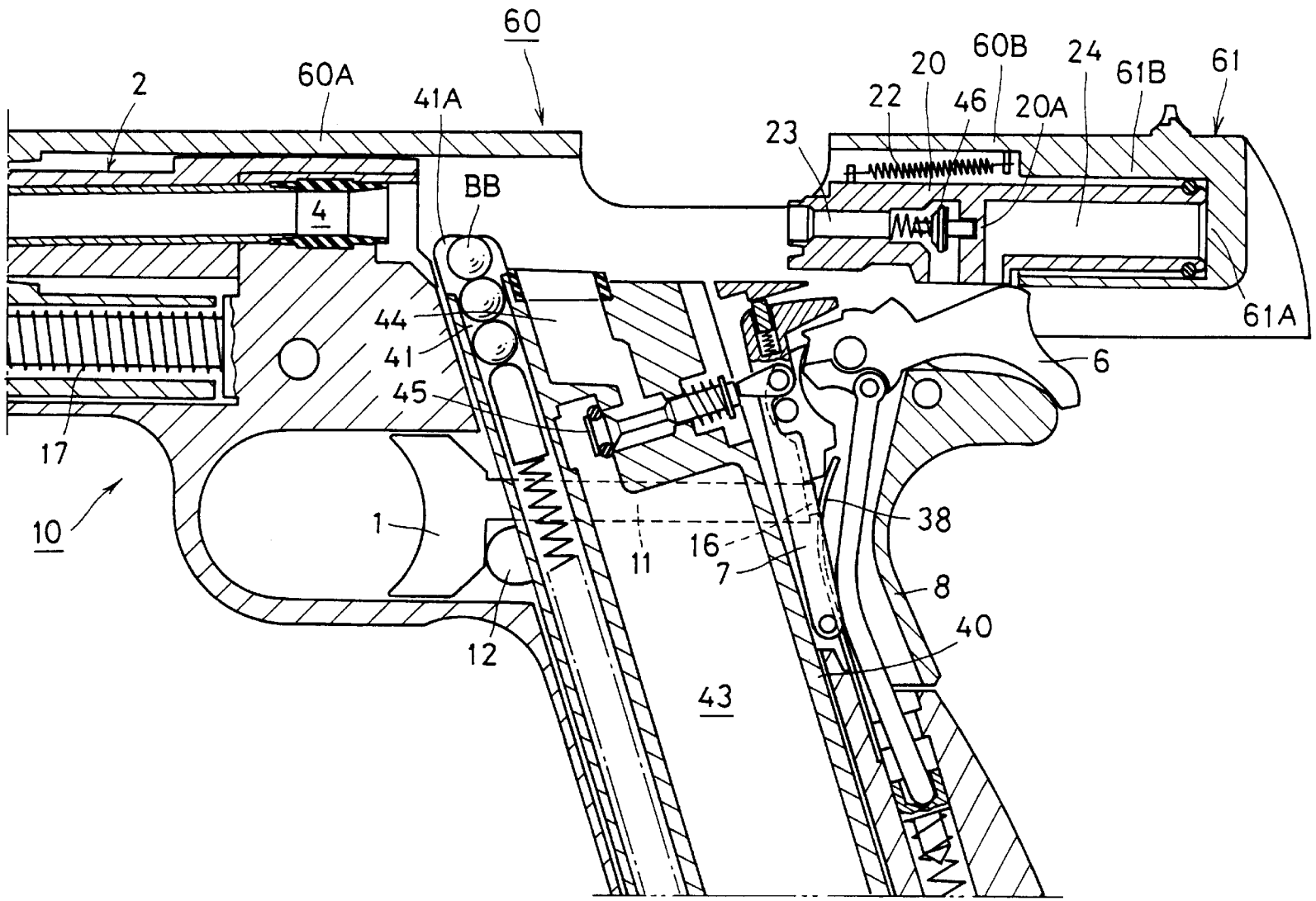

Just after the gas leading passage 44 is closed by the movable valve 45, the slider 60 is further moved back with the force of inertia. Then, just before the slider 60 reaches to the rearmost position, the read portion of the movable member 20 is put out of the tubular portion 61B of the cup-shaped member 61 so that the gas in the tubular portion 61B of the cup-shaped member 61 is discharged from the opening facing the movable member 20, as shown in FIG. 9, and the pressure of gas in the tubular portion 61B of the cup-shaped member 61 is rapidly reduced to the atmospheric pressure. Then, the movable member 20 is quickly moved back toward the cup-shaped member 61 by the coil spring 22 so that the read portion of the movable member 20 is again inserted in the tubular portion 61B of the cup-shaped member 61, as shown in FIG. 10. As a result, the upper end portion 41A of the magazine 41 is made open and one of the sham bullets BB at the top in the magazine 41 is pushed up into the upper end portion 41A of the magazine 41 to be held therein.

Just after the slider 60 has reached to the rearmost position, as shown in FIG. 10, the slider 60 is moved forward by the coil spring 17 toward the reference position and the movable member 20 is also moved forward in company with the slider 60. With such forward movement of the movable member 20, the front portion of the movable member 20 carries the sham bullet BB held in the upper end portion 41A of the magazine 41 toward the bullet holding chamber 4. When the slider 60 is put in the reference position again, the sham bullet BB is surely held in the bullet holding chamber 4, as shown in FIG. 5.

When the slider 60 has reached to the rearmost position, the trigger 1 is released from the pull operation. Then, the movable bar member 11 and the trigger 1 is moved forward by the engaging portion 38B (shown in FIG. 3) of the leaf spring 38 acting on the movable contact member 16 at the lower position thereof and the trigger 1 returns to the initial position, as shown in FIG. 5. The movable contact member 16 at the lower position thereof is fixed in position by the engaging portion 38B of the leaf spring 38 to engage with the recess 60D (shown in FIG. 3) provided on the bottom of the slider 60 at the upper portion thereof.

Further, when the slider 60 has reached to the reference position from the rearmost position, under the situation wherein one end of the first inner space 23 in the movable member 20 is connected with the bullet holding chamber 4 and one end of the second inner space 24 in the movable member 20 is positioned to face closely the pressure receiving portion 61A, the gas leading passage 44 extending from the pressure accumulating chamber 43 is connected with both of the other ends of the first and second inner spaces 23 and 24 formed in the movable member 20, as shown in FIG. 5. After that, when the trigger 1 is pulled again, the shooting of the sham bullet BB held in the bullet holding chamber 4 and the supply of a new sham bullet BB to the bullet holding chamber 4 are carried out in the same manner as that mentioned above.

Figure 11:
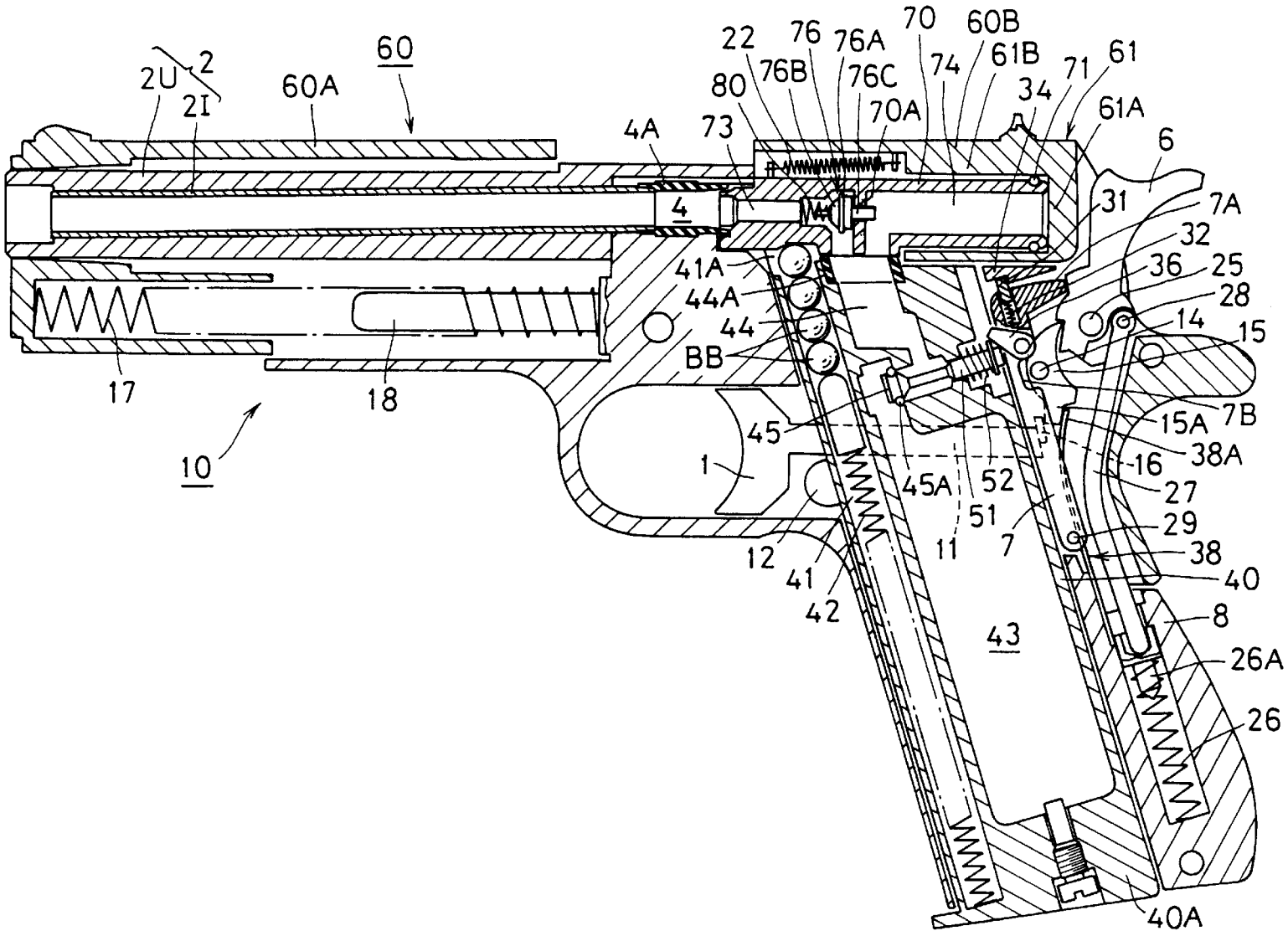
FIG. 11 is a schematic cross sectional view showing another embodiment of model gun with automatic bullet supplying mechanism according to the present invention.

FIG. 11 shows another embodiment of model gun with automatic bullet supplying mechanism according to the present invention.

In the embodiment shown in FIG. 11, a movable member 70 is employed in place of the movable member 20 in the embodiment shown in FIG. 1, and various parts other than the movable member 70 are constituted in the same manner as those in the embodiment shown in FIG. 1. In FIG. 11, portions and members corresponding to those in FIG. 1 are marked with the same references and further description thereof will be omitted.

Referring to FIG. 11, the movable member 70 is provided in a rear portion 60B of a slider 60. The movable member 70 is positioned at the back of a bullet holding chamber 4 to be movable along the moving directions of the slider 60 and has a rear portion which is put selectively in and out of a tubular portion 61B of a cup-shaped member 61, a front portion which is coupled selectively with a tubular member 4A in which the bullet holding chamber 4 is formed, and a mid portion between the rear and front portions. A sealing ring member 71 made of elastic material is mounted on the rear portion of the movable member 70. When the rear portion of the movable member 70 is inserted in the tubular portion 61B of the cup-shaped member 61, the sealing ring member 71 comes into contact with the inner surface of the tubular portion 61B to seal hermetically a space between the outer surface of the rear portion of the movable member 70 and the inner surface of the tubular portion 61B.

A coil spring 22 is provided with one end attached to the tubular portion 61B of the cup-shaped member 61 and the other end attached to the movable member 70 for exerting the elastic force to the movable member 70 to put the same in tendency of moving toward a pressure receiving portion 61A which is provided in the form of the bottom of the cup-shaped member 61. When the slider 60 is put in the reference position, the movable member 70 is put in such a position as to cause the front portion thereof to be coupled with the tubular member 4A in which the bullet holding chamber 4 is formed and to cause the rear portion thereof to be inserted in the tubular portion 61B of the cup-shaped member 61.

The movable member 70 is provided with a first inner space 73 and a second inner space 74 to be separated from each other by a partition wall 70A provided at the mid portion of the movable member 70. The first inner space 73 constitutes a curved gas passage with one end opening toward the bullet holding chamber 4 at the front portion of the movable member 70 and the other end opening downward at the mid portion of the movable member 70. The second inner space 74 constitutes also a curved gas passage with one end opening toward the pressure receiving portion 61A at the rear portion of the movable member 70 and the other end opening downward at the mid portion of the movable member 70.

When the slider 60 is put in the reference position and the movable member 70 is put in a position corresponding to the reference position of the slider 60, one end of the first inner space 73 is connected with the bullet holding chamber 4, one end of the second inner space 74 is positioned to face closely the pressure receiving portion 61A, and each of the first and second inner spaces 73 and 74 is connected with a gas leading passage 44.

A portion of the gas leading passage 44 which comes into contact with the mid portion of the movable member 70 is constituted by a packing member 44A. With the packing member 44A thus provided, gas leakage from the connection between the gas leading passage 44 and each of the other ends of the first and second inner spaces 73 and 74 each opening downward at the mid portion of the movable member 70 is surely prevented.

A movable valve 76 is provided in the first inner space 73 formed in the movable member 70 for constituting a gas control device to a pressure accumulating chamber 43 together with a movable valve 45 provided in the gas leading passage 44. The movable valve 76 is provided with a large diameter portion 76B to which a ring seal member 76A is attached and a shaft portion 76C extending from the large diameter portion 76B and accommodated in a bent portion of the first inner space 73 formed in the movable member 70. The shaft portion 76C of the movable valve 76 is inserted into a through hole formed on the partition wall 70A which is provided at the mid portion of the movable member 70 so that the whole of the movable valve 76 is supported to be movable by the partition wall 70A and forced by a coil spring 80 engaging with the large diameter portion 76B to cause its end to project into the second inner space 74 formed in the movable member 70. Accordingly, the movable valve 76 accommodated in the first inner space 73 formed in the movable member 70 is normally positioned to cause the large diameter portion 76B to be distant from one end of the first inner space 73 so as to make the first inner space 73 formed in the movable member 70 open, as shown in FIG. 11.

In the embodiment shown in FIG. 11 thus constituted also, when the slider 60 is once moved back manually from the reference position and then released to return to the reference position, a sham bullet BB is supplied to the bullet holding chamber 4 and the other end of the gas leading passage 44 extending from the pressure accumulating chamber 43 is again connected with the other end of each of the first and second inner spaces 73 and 74 formed in the movable member 70 under the condition wherein one end of the first inner space 73 is connected with the bullet holding chamber 4 and one end of the second inner space 74 is positioned to face closely the pressure receiving portion 61A.

After the sham bullet BB has been supplied to the bullet holding chamber 4, when the trigger 1 is pulled, various operations same as those in the embodiment shown in FIG. 1 are performed. That is, during a period in which the gas leading passage 44 extending from the pressure accumulating chamber 43 is connected with the first and second inner spaces 73 and 74 formed in the movable member 70 and the movable valve 45 controls the gas leading passage 44 to be open under a condition wherein the slider 60 is put in the reference position and the movable member 70 is put in the position corresponding to the reference position of the slider 60, the movable valve 76 accommodated in the first inner space 73 formed in the movable member 70 is operative selectively to control the first inner space 73 to be open so as to cause the gas derived through the gas leading passage 44 from the pressure accumulating chamber 43 to act through the first inner space 73 on the sham bullet BB in the bullet holding chamber 4 and to control the first inner space 73 to be closed so as to shut off the gas flow to the bullet holding chamber 4 through the first inner space 73 from the gas leading passage 44 so that the gas derived through the gas leading passage 44 from the pressure accumulating chamber 43 acts through the second inner space 74 formed in the movable member 70 on the pressure receiving portion 61A to cause the pressure receiving portion 61A to move back in company with the slider 60.

The structure of each of the movable members 20 and 70 employed in the above described embodiments is just an example which can be used in the model gun with automatic bullet supplying mechanism according to the present invention and each of the movable members 20 and 70 should not be limited to have the structure described above. For example, it is possible for each of the movable members 20 and 70 to contain therein inner spaces other than the first and second spaces 23 and 24 or 73 and 74 explained above and a movable valve other than the movable valve 46 or 76 also explained above.

What is claimed is:

1. A model gun with automatic bullet supplying mechanism, comprising:

a pressure accumulating chamber from which a gas leading passage extends, a first movable valve for controlling the gas leading passage to be open and closed selectively, a bullet holding chamber provided in the rear portion of a barrel structure, a slider provided to be movable along the barrel structure, a pressure receiving portion fixed in the slider to be positioned at the back of the barrel structure and movable with the slider, a movable member provided with a first inner space which opens toward the bullet holding chamber and is selectively connected with the gas leading passage and a second inner space which opens toward the pressure receiving portion and is selectively connected with the gas leading passage and arranged at the back of the bullet holding chamber to be movable along moving directions of the slider, and a second movable valve provided in said first inner space formed in the movable member, said second movable valve being operative selectively, during a period in which the gas leading passage is connected with said first and second inner spaces formed in the movable member and the first movable valve controls the gas leading passage to be open, to cause gas derived through the gas leading passage from the pressure accumulating chamber to act through said first inner space on a sham bullet in the bullet holding chamber and to close said first inner space to shut off gas flow to the bullet holding chamber through said first inner space from the gas leading passage so that the gas derived through the gas leading passage from the pressure accumulating chamber acts through said second inner space on the pressure receiving portion to cause first the pressure receiving portion to move back to company with the slider and then the movable member also to move back from making preparations for supplying the bulleting holding chamber with a sham bullet from a magazine; wherein said second movable valve is operative to maintain said second inner space formed in the movable member open.

2. A model gun with automatic bullet supplying mechanism according to claim 1, wherein each of said first and second inner spaces formed in the movable member is selectively connected with the gas leading passage in dependence on the position of the movable member.

3. A model gun with automatic bullet supplying mechanism according to claim 1, wherein said second movable valve is forced to be put in tendency of moving in a direction for making said first inner space open and moved by pressure of gas reduced in said first inner space in a direction for making said first inner space closed.

4. A model gun with automatic bullet supplying mechanism according to claim 1, wherein said second movable valve is provided with a closure portion for making said first inner space open and closed selectively and a shaft portion extending from said closure portion and supported by a partition wall provided in the movable member for separating said first and second inner spaces from each other.

5. A model gun with automatic bullet supplying mechanism according to claim 4, wherein said second movable valve is forced to put said closure portion in a position for making said first inner space open.

* * * * *